US011337298B2

(12) United States Patent
Liu et al.

(10) Patent No.: US 11,337,298 B2
(45) Date of Patent: May 17, 2022

(54) RADIO FREQUENCY ELECTRON ACCELERATOR FOR LOCAL FREQUENCY MODULATION AND FREQUENCY MODULATION METHOD THEREOF

(71) Applicant: ChengDu Elekom Vacuum Electron Technology Co. Ltd, Chengdu (CN)

(72) Inventors: Xiansheng Liu, Chengdu (CN); Lin Zhou, Chengdu (CN); Huiyuan Zhang, Chengdu (CN); Hao Tao, Chengdu (CN)

(73) Assignee: CHENGDU ELEKOM VACUUM ELECTRON TECHNOLOGY CO. LTD, Chengdu (CN)

( * ) Notice: Subject to any disclaimer, the term of this patent is extended or adjusted under 35 U.S.C. 154(b) by 0 days.

(21) Appl. No.: 17/037,764

(22) Filed: Sep. 30, 2020

(65) Prior Publication Data

US 2022/0070995 A1 Mar. 3, 2022

(30) Foreign Application Priority Data

Aug. 31, 2020 (CN) ..... 202010895405.1

(51) Int. Cl.
*H05H 7/02* (2006.01)

(52) U.S. Cl.
CPC ..... *H05H 7/02* (2013.01); *H05H 2007/025* (2013.01)

(58) Field of Classification Search
None
See application file for complete search history.

(56) References Cited

U.S. PATENT DOCUMENTS 3,527,976 A * 9/1970 Thal, Jr. ..... H01J 23/24 315/3.6
3,532,924 A * 10/1970 Roumbanis ..... H01J 23/24 315/3.5
3,546,524 A * 12/1970 Stark ..... H05H 9/04 315/5.41
3,906,300 A * 9/1975 Tran ..... H05H 9/04 315/5.42
4,024,426 A * 5/1977 Vaguine ..... H05H 9/04 315/5.41

(Continued)

*Primary Examiner* — Srinivas Sathiraju
(74) *Attorney, Agent, or Firm* — Bayramoglu Law Offices LLC

(57) ABSTRACT

A radio frequency electron accelerator structure for local frequency modulation includes an accelerating cavity, a coupling cavity, and a beam hole. The accelerating cavity and the coupling cavity are alternately assembled together, and the beam hole penetrates the accelerating cavity and the coupling cavity. A local cutting area is arranged inside both the accelerating cavity and the coupling cavity. A local frequency modulation method for a radio frequency electron accelerator is further provided. In the frequency modulation stage of the accelerating cavity, the local cutting area of the accelerating cavity is cut. When the feed amount is large, the change of the volume of the cavity is still small, and the generated frequency variation of the cavity is small, which significantly reduces the difficulty of frequency modulation, lowers the accuracy requirements of machine tools at the same time, and decreases the cost of enterprises accordingly.

2 Claims, 9 Drawing Sheets

(56) References Cited

U.S. PATENT DOCUMENTS 4,118,652 A * 10/1978 Vaguine ..... H01J 23/24 315/5.41
4,122,373 A * 10/1978 Vaguine ..... H01J 23/24 315/39.53
4,146,817 A * 3/1979 McEuen ..... H05H 9/04 315/5.41
4,147,956 A * 4/1979 Horigome ..... H01J 25/38 315/3.5
4,287,488 A * 9/1981 Brau ..... H01S 3/0903 359/335
4,807,355 A * 2/1989 Harper ..... H01J 23/26 29/600
4,829,261 A * 5/1989 DeSantis ..... H01J 23/40 315/3.6
4,851,736 A * 7/1989 Harper ..... H01J 23/24 315/3.5
4,988,919 A * 1/1991 Tanabe ..... H05H 7/18 313/360.1
5,578,909 A * 11/1996 Billen ..... H05H 7/18 315/500
5,734,168 A * 3/1998 Yao ..... A61N 5/10 250/492.3
5,744,919 A * 4/1998 Mishin ..... H05H 9/00 315/500
6,407,505 B1 * 6/2002 Bertsche ..... H05H 9/04 315/5.41
6,417,622 B2 * 7/2002 Theiss ..... H01J 23/22 315/3.5
6,593,695 B2 * 7/2003 Theiss ..... H01J 23/22 315/3.5
6,617,810 B2 * 9/2003 Symons ..... H05H 7/18 250/292
6,646,383 B2 * 11/2003 Bertsche ..... H05H 7/18 315/111.61
6,674,254 B2 * 1/2004 Hanna ..... H05H 7/18 250/492.3
7,746,192 B2 * 6/2010 McIntyre ..... H05H 7/18 333/99 S
7,898,193 B2 * 3/2011 Miller ..... H05H 9/04 315/505
8,111,025 B2 * 2/2012 Whittum ..... H05G 1/04 315/505
8,232,749 B1 * 7/2012 Barov ..... H05H 9/044 315/505
8,610,380 B2 * 12/2013 Vaccaro ..... H05H 9/04 315/505
8,731,628 B1 * 5/2014 Agassi ..... H01L 39/24 505/210
9,030,134 B2 * 5/2015 Whittum ..... H05G 1/10 315/505
9,258,876 B2 * 2/2016 Cheung ..... H05H 9/02
9,380,695 B2 * 6/2016 Dolgashev ..... H05H 7/02
9,398,681 B2 * 7/2016 Tantawi ..... H05H 7/18
10,314,151 B2 * 6/2019 Whittum ..... H05G 1/10
10,362,666 B2 * 7/2019 Mustapha ..... H05H 7/02
2004/0108823 A1 * 6/2004 Amaldi ..... H05H 7/22 315/505
2011/0089871 A1 * 4/2011 Vaccaro ..... H05H 9/04 315/505
2014/0191654 A1 * 7/2014 Tantawi ..... H05H 7/18 315/5.41
2014/0265826 A1 * 9/2014 Goren ..... H01J 23/30 315/3.5
2015/0245462 A1 * 8/2015 Nighan, Jr ..... H05H 9/048 378/138
2017/0265292 A1 * 9/2017 Mishin ..... H05H 9/04
2018/0027644 A1 * 1/2018 Cooley ..... H01P 7/06 505/210
2018/0343733 A1 * 11/2018 Mustapha ..... H05H 9/044
2020/0187345 A1 * 6/2020 Tanabe ..... H05H 9/048
2020/0273684 A1 * 8/2020 Jurczyk ..... C23C 14/3407

* cited by examiner

First cutting

Second cutting

Third cutting

First cutting

Second cutting

Third cutting

First cutting

Second cutting

Third cutting

RADIO FREQUENCY ELECTRON ACCELERATOR FOR LOCAL FREQUENCY MODULATION AND FREQUENCY MODULATION METHOD THEREOF

CROSS REFERENCE TO THE RELATED APPLICATIONS

This application is based upon and claims priority to Chinese Patent Application No. 202010895405.1, filed on Aug. 31, 2020, the entire contents of which are incorporated herein by reference.

TECHNICAL FIELD

The present invention relates to the technical field of an accelerator frequency modulation, in particular to a radio frequency electron accelerator for local frequency modulation and a frequency modulation method thereof.

BACKGROUND

Electron linear accelerator is a kind of acceleration device that uses microwave electromagnetic field to accelerate electrons, and it has a linear motion orbit. It is widely used in the medical field, for example, the most important component of the common CT machine (i.e. computed tomography camera) is the electron linear accelerator, and its basic principle is to use the accelerator to accelerate electrons to further generate high-energy X-rays.

Microwave, also known as "ultra-high frequency electromagnetic wave", usually propagates in a waveguide tube, which is typically a circular waveguide tube. However, the phase velocity, i.e. the transmission speed of phase in space, which is the abbreviation of phase moving speed, of microwave propagation in the waveguide tube is much greater than the speed of light. The phase velocity of micro wave electromagnetic field propagates excessively too fast to accelerate the electrons. Therefore, it is necessary to reduce the phase velocity of microwave propagation in the waveguide tube. In order to solve this problem, the existing methods in the prior art teaches periodically inserting a circular diaphragm with a middle hole into the circular wave tube to slow down the phase velocity of microwave propagation by means of the reflection of the diaphragm, so that the microwave electromagnetic field can exchange energy with the injected electrons to accelerate the electrons. Such a waveguide tube is called a disk-loaded waveguide accelerating tube, the circular diaphragm is loaded on the waveguide tube, and it can also be called a slow wave structure.

Thus, it can be seen that the disk-loaded waveguide accelerator, or slow wave structure, that is mentioned above is one of the key components constituting the electron linear accelerator. When the phase of the electron in the microwave electromagnetic field of the disk-loaded waveguide accelerating tube matches with the acceleration phase, the electromagnetic field energy is converted into electron energy, and the electron is accelerated. When the phase of the electron in the microwave electromagnetic field of the disk-loaded waveguide accelerating tube matches the deceleration phase, the electron energy is converted into electromagnetic field energy, and the electron is decelerated. Thus, the prior art provided the following two different methods of electron acceleration in order to ensure that electrons can be continuously accelerated to obtain high energy.

The first method that the prior art describes is the traveling wave acceleration method, which corresponds to the traveling wave electron linear accelerator. The core principle of this method is to make the velocity of the electron equal to the phase velocity of the traveling wave, both of the velocity of the electron and the phase velocity of the traveling wave meet the synchronization condition, so that the electron can be accelerated on the wave crest of the electric field throughout.

The second method that the prior art describes is the standing wave acceleration method, which corresponds to the standing wave electron linear accelerator. The core principle of this method is to make the electron subjected to the acceleration phase of the electric field when the electron flies in each cavity of the disk-loaded waveguide accelerating tube, the time of the electron flying in one cavity is equal to the half period of oscillation of the electromagnetic field in the accelerating tube, and the flying time of the electron is identical to the direction changing time of the accelerating electric field, so as to continuously accelerate the electron.

Among them, with respect to the standing wave acceleration method, one of the prerequisites for achieving the continuous acceleration of the electron is: each cavity in the disk-loaded waveguide accelerating tube is an electromagnetic resonant cavity with an identical intrinsic frequency f0, all cavities resonate at an identical frequency and are also consistent with the microwave frequency. The intrinsic frequency f0 of the cavity usually depends on the size of the inner diameter R of the cavity, and the two are inversely correlated, meaning if the inner diameter of the cavity is large, then f0 is small, or, if the inner diameter of the cavity is small, then f0 is large. The fundamental principle is that the intrinsic frequency of the cavity of the accelerator is related to the volume of the cavity. When the processed size of the cavity of the accelerating tube is in accordance with the desired frequency, the accelerating tube can meet the aforementioned precondition for continuously accelerating the electrons. However, in the actual machining process, when the tester measures the frequency of each cavity of the accelerating tubes that are processed from the manufacturer, the value of the intrinsic frequency f0 of some cavities is outside of its tolerance, namely it is either too larger or too smaller comparing to the desired frequency, which does not meet the design expectation. Typically, if the measured frequency of a certain processed cavity is larger than the desired frequency, it needs to be decreased. One common method is to increase the inner diameter R by cutting the inner wall of the cavity tube to increase the volume of the cavity. On the other hand, if the measured frequency of a certain processed cavity is smaller than the desired frequency, it needs to be increased, meaning the inner diameter R of the cavity needs to be decreased. The common method also inserts a small rod into the hole slot arranged on the outer wall of the cavity tube, and then knock the small rod to deform the inner wall of the cavity tube to further reduce the inner diameter dimension R of the cavity, therefore increasing the frequency. However, the disadvantage of this method is that part of the electromagnetic field in the cavity is easily converted into a high-order electromagnetic field, but the high-order electromagnetic field cannot accelerate the electron, which causes the loss of electromagnetic energy, and the energy obtained by the electron is also reduced accordingly. Therefore, it is desirable to develop an optimal solution that can increase the intrinsic frequency of the cavity of the disk-loaded waveguide accelerating tube that uses the standing wave acceleration method to accelerate the electron.

In general, when machining components of the accelerator, a certain amount of machining allowance is reserved. If the diameter of the cavity is calculated as D by simulation, only D-0.02 mm can be machined during the machining process of the machine tool, and the allowance of 0.01 mm (feed amount in the radius direction) is reserved. For example, the frequency deviation corresponding to this part of machining allowance is 5 MHz. Due to the accuracy problem of the machine tool itself (such as cylindricity, profile, etc.), the frequency deviation of machined components is measured to be 6 MHz. Then, the simulation calculation is performed again according to the measurement result. The calculation result indicates that it is necessary to cut 0.012 mm in the radius of the cavity. This cutting amount will be processed by several stages, and this micro machining process is referred to as the frequency modulation stage.

In the actual use, the inventor found that the prior arts have at least the following technical problems.

In the frequency modulation stage of the prior arts, the cavity of the accelerator still adopts the same machining method as that in the rough turning stage. The volume of the cavity is adjusted by the overall cutting method, which involves a relatively large machining surface. Yet when the feed amount is small, the change of the volume of the cavity is still large, and the frequency of the cavity changes greatly, making it difficult to adjust the frequency. Besides, in order to realize the precise adjustment of the intrinsic frequency of the cavity of the accelerator, the existing manufacturers need to constantly update the machine tools with the increased precision, which causes an increase in its cost and the difficulties that are associated with machine processing.

SUMMARY

In order to overcome the above shortcomings, after putting a lot of efforts in engaging long-term explorations and conducting many experiments, the inventor of the present invention proposes a radio frequency electron accelerator for local frequency modulation and a frequency modulation method thereof. The method adopts the local frequency modulation technology. When the feed amount is large, the change of the volume of the cavity is still small, and the generated frequency variation of the cavity is small, which reduces the difficulty of frequency modulation, lowers the accuracy requirements of machine tools, and decreases the equipment cost of enterprises accordingly.

In order to achieve the above objective, the present invention adopts the following technical solution. A radio frequency electron accelerator structure for local frequency modulation includes an accelerating cavity, a coupling cavity, and a beam hole. The accelerating cavity and the coupling cavity are alternately assembled together, and the beam hole penetrates the accelerating cavity and the coupling cavity. A local cutting area is arranged inside both of accelerating cavity and the coupling cavity.

Preferably, the accelerating cavity and the coupling cavity are formed by superimposing a coupling cavity component and an accelerating cavity component alternately; a complete coupling cavity contour is provided on the left side of the coupling cavity component, and the left side of the coupling cavity component is open; one half of a cavity body of the accelerating cavity is provided on the right side of the coupling cavity component, and an opening surface of the cavity body is configured to face the right side of the accelerating cavity; the other half of the cavity body of the accelerating cavity is provided on the left side of the accelerating cavity component, and an opening surface of the cavity body is configured to face the left side of the accelerating cavity; a wall surface of the right side of the accelerating cavity component serves as a closed surface of the coupling cavity.

Preferably, an accelerating cavity local cutting area on any one of the coupling cavity component and the accelerating cavity component is limited to an area that is shaped as a ring configured to have a cross section of a 1×1 mm square, and an inner diameter of the ring is equal to an inner diameter of the cavity body of the accelerating cavity.

Preferably, the accelerating cavity local cutting area is located on the coupling cavity component and the accelerating cavity component, respectively, and a starting plane is a plane where the coupling cavity component and the accelerating cavity component joint together to form the accelerating cavity; and the accelerating cavity local cutting area arranged on the coupling cavity component and the accelerating cavity component integrally forms an annular area that is 2×1 mm.

Preferably, a coupling cavity local cutting area is limited to an area shaped as a ring configured to have a cross section of a 0.5×0.5 mm square, the ring is located on the coupling cavity component, and a starting plane is a plane where the accelerating cavity component and the coupling cavity component joint together to form the coupling cavity; and an inner diameter of the ring is equal to an inner diameter of a cavity body of the coupling cavity.

Preferably, the accelerating cavity and the coupling cavity are formed by superimposing an accelerating cavity component and a coupling cavity component alternately, the accelerating cavity component is provided with a complete accelerating cavity, and the coupling cavity component is provided with a complete coupling cavity.

Preferably, an accelerating cavity local cutting area is limited to an area shaped as a ring configured to have a cross section of a 1×1 mm square, the ring is located on the accelerating cavity component, and a starting plane is a plane where the accelerating cavity component and the coupling cavity component joint together to form the accelerating cavity; and an inner diameter of the ring is equal to an inner diameter of a cavity body of the accelerating cavity.

Preferably, a coupling cavity local cutting area is limited to an area shaped as a ring configured to have a cross section of a 0.5×0.5 mm square, the ring is located on the coupling cavity component, a starting plane is a plane where the accelerating cavity component and the coupling cavity component joint together to form the coupling cavity; and an inner diameter of the ring is equal to an inner diameter of a cavity body of the coupling cavity.

A local frequency modulation method for a radio frequency electron accelerator according to the present invention, a further preferred technical solution is: an accelerating cavity component and a coupling cavity component joint together to form the accelerator; in a machining process, first separating the accelerating cavity component and the coupling cavity component, then performing a cutting on a wall surface of a cavity body formed by the accelerating cavity component and the coupling cavity component, and finally assembling the accelerating cavity component and the coupling cavity component into a complete accelerating tube; the cutting is divided into a rough turning stage and a frequency modulation stage, and the cutting is performed as follows:

(1) overall cutting: suitable for the rough turning stage; when each wall surface of the accelerator that is formed by the accelerating cavity component and the coupling cavity component is cut into a plurality of components meeting the specifications according to drawings, integrally cutting an inner surface of the cavity body of the accelerator to quickly reduce the difference between a current intrinsic frequency and a target intrinsic frequency of the cavity body of the accelerating cavity and leave a machining allowance for the frequency modulation stage; and (2) local cutting: suitable for the frequency modulation stage; only cutting a local cutting area of the cavity body of the accelerator that is formed by the accelerating cavity component and the coupling cavity component to precisely adjust the current intrinsic frequency of the cavity body to reach the target intrinsic frequency or to fall within an allowable error range of the target intrinsic frequency.

Preferably, the local cutting adopts a plurality of cutting to ensure a machining accuracy, and a cutting shape is a superimposition of horizontal or vertical square areas, or a superimposition of inclined triangular areas.

Compared with the prior art, the technical solutions of the present invention have the following advantages.

1. The present invention adopts the local frequency modulation technology in the frequency modulation stage. When the feed amount is large, the change of the volume of the cavity is still small, and the generated frequency variation of the cavity is small, which reduces the difficulty of frequency modulation, lowers the accuracy requirements of machine tools, and decreases the equipment cost of enterprises accordingly.

2. Since the positions at both ends of the cavity body are selected as the local cutting portions, which are the areas with the lowest electric field intensity in the entire accelerating cavity, cutting in these areas has the least influence on the electric field distribution.

BRIEF DESCRIPTION OF THE DRAWINGS

In order to explain the technical solutions of the embodiments of the present invention more clearly, the drawings that need to be used in the embodiments are described in detail below. It should be understood that these drawings only show certain embodiments of the present invention, and therefore they should not be regarded as a limitation to the scope of the present invention. For those skilled in the art, other related drawings can be obtained based on these drawings without creative effort.

Figure 1:
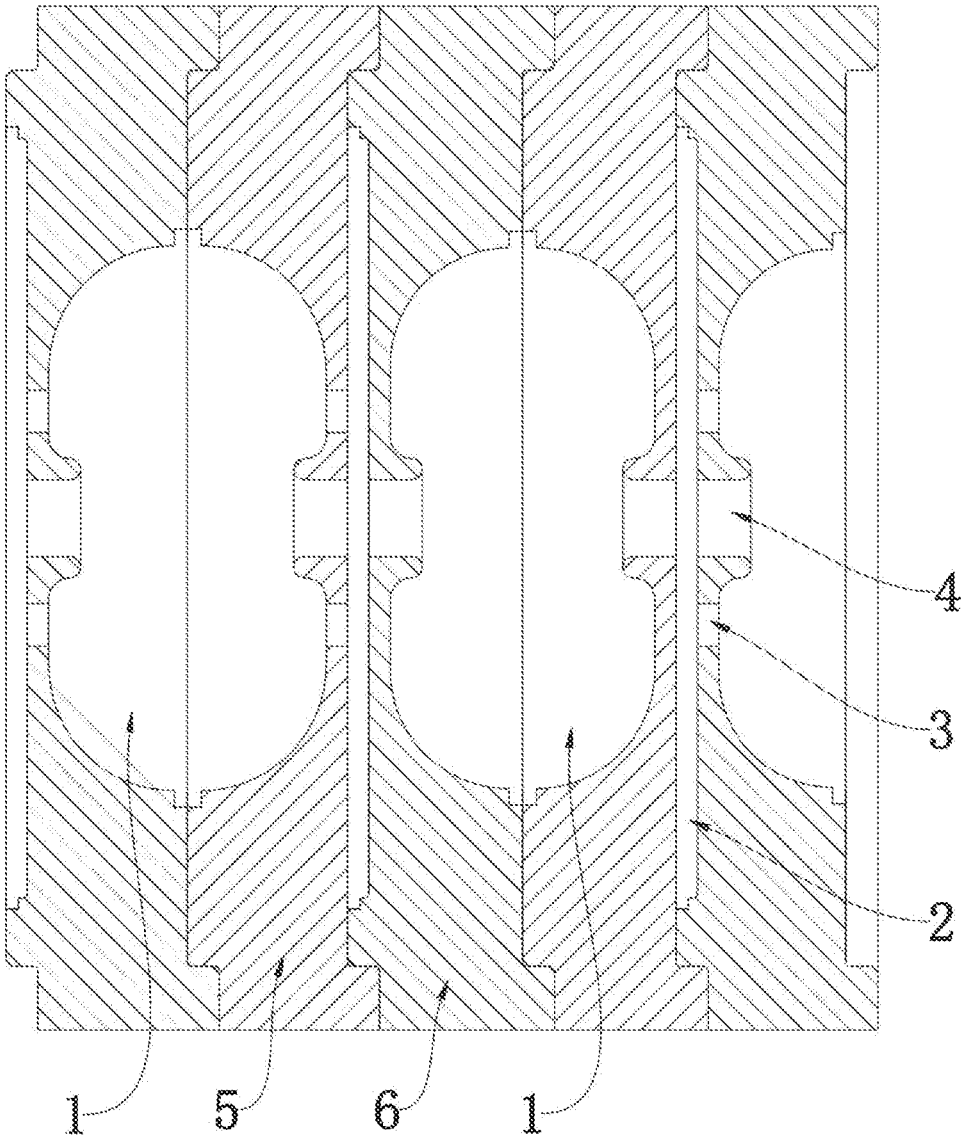
FIG. 1 is a schematic diagram of the radio frequency electron accelerator structure A for local frequency modulation according to the present invention.

In the figures: 1—accelerating cavity; 2—coupling cavity; 3—coupling hole; 4—beam hole; 5—accelerating cavity component; 6—coupling cavity component; 701—accelerating cavity local cutting area; 702—coupling cavity local cutting area; 8—overall cutting area; 9—first overall cutting area; 10—second overall cutting area; 11—third overall cutting area; 12—first local cutting area; 13—second local cutting area; and 14—third local cutting area.

DETAILED DESCRIPTION OF THE EMBODIMENTS

In order to explain the objectives, technical solutions and advantages of the present invention clearer, the technical solutions in the embodiments of the present invention are described below clearly and completely. Obviously, the described embodiments are a part of the embodiments of the present invention, rather than all of them. Based on the embodiments of the present invention, all other embodiments obtained by those skilled in the art without creative work shall fall within the scope of protection of the present invention. Therefore, the detailed description of the embodiments of the present invention provided below is not intended to limit the scope of the claimed invention, but merely represents selected embodiments of the present invention.

It should be noted that similar reference numerals and letters indicate similar items in the following drawings. Therefore, once a term is defined in one drawing, it may not be further defined and explained in the subsequent drawings.

Embodiment 1

Figure 2:
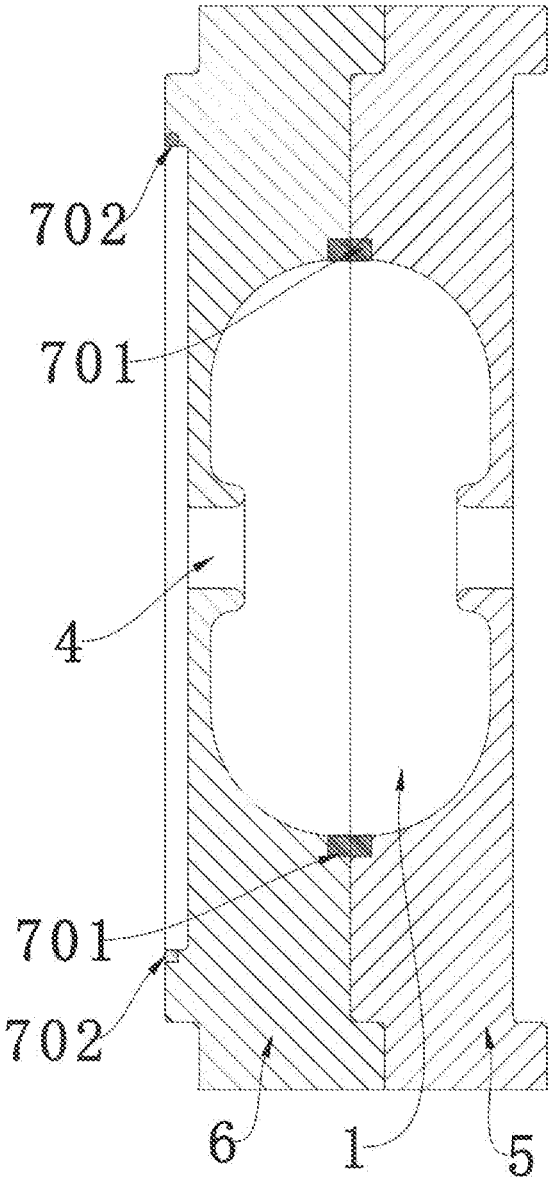
FIG. 2 is a schematic diagram of the cutting area of the radio frequency electron accelerator structure A for local frequency modulation according to the present invention.

As shown in FIG. 1 and FIG. 2, a radio frequency electron accelerator structure for local frequency modulation, includes the accelerating cavity 1, the coupling cavity 2 and the beam hole 4. The accelerating cavity 1 and the coupling cavity 2 are alternately assembled together, and the beam hole 4 penetrates the accelerating cavity 1 and the coupling cavity 2. A local cutting area is arranged inside the accelerating cavity 1 and the coupling cavity 2. The accelerator is provided with the coupling hole 3. As shown in FIG. 1, a notch is left inside both the accelerating cavity and the coupling cavity after local cutting, and the notch is shaped as a rectangular recess.

The overall structure of the accelerator can be changed according to actual conditions and needs, and its components can also be adjusted. The following two accelerator structures are exemplified to illustrate the specific applications of local cutting.

Accelerator structure A: as shown in FIG. 1 and FIG. 2, the final structure of the accelerator after local cutting is to form a circular groove in the middle of the accelerating cavity and on the edge of the coupling cavity of the accelerator, respectively. The accelerating cavity 1 and the coupling cavity 2 are formed by the alternate superimposition of the coupling cavity component 6 and the accelerating cavity component 5, that is, the entire accelerator is formed by superimposing the accelerating cavity component 5 and the coupling cavity component 6. A complete coupling cavity contour is provided on the left side of the coupling cavity component 6, and the left side of the coupling cavity component 6 is open. One half of a cavity body of the accelerating cavity is provided on the right side of the coupling cavity component, and the opening surface of the cavity body is configured to face the right side of the accelerating cavity. The other half of the cavity body of the accelerating cavity is provided on the left side of the accelerating cavity component 5, and the opening surface of the cavity body is configured to face the left side of the accelerating cavity. The wall surface of the right side of the accelerating cavity component serves as a closed surface of the coupling cavity.

The accelerating cavity local cutting area 701 on any one of the coupling cavity component and the accelerating cavity component is limited to an area shaped as a ring configured to have a cross section of a 1×1 mm square. The ring is located on the joint plane of the accelerating cavity component 5 and the coupling cavity component 6. The inner diameter of the ring is equal to the inner diameter of the cavity body of the accelerating cavity. The cutting area in the accelerating cavity is located in the middle of the accelerating cavity, on the joint plane of the accelerating cavity component 5 and the coupling cavity component 6. Additionally, the machining position is on the edges of after the splitting of the accelerating cavity component 5 and the coupling cavity component 6.

The accelerating cavity local cutting area is located on the coupling cavity component 6 and the accelerating cavity component 5, respectively, and a starting plane is a plane where the coupling cavity component 6 and the accelerating cavity component 5 joint together to form the accelerating cavity. The accelerating cavity local cutting area on the coupling cavity component 6 and the accelerating cavity component 5 integrally forms an annular area of 2×1 mm.

The coupling cavity local cutting area 702 is limited to an area shaped as a ring configured to have a cross section of a 0.5×0.5 mm square. The ring is located on the edge of the coupling cavity of the coupling cavity component 6, parallel to the joint plane of the accelerating cavity component 5 and the coupling cavity component 6. The inner diameter of the ring is equal to the inner diameter of the cavity body of the coupling cavity. In other words, the ring is located on the coupling cavity component, a starting plane is a plane where the accelerating cavity component and the coupling cavity component joint together to form the coupling cavity, and the inner diameter of the ring is equal to the inner diameter of the cavity body of the coupling cavity.

A matching ladder is provided on two ends of the accelerating cavity component 5 and the coupling cavity component 6 to facilitate the installation of the accelerating cavity component 5 and the coupling cavity component 6.

Figure 3:
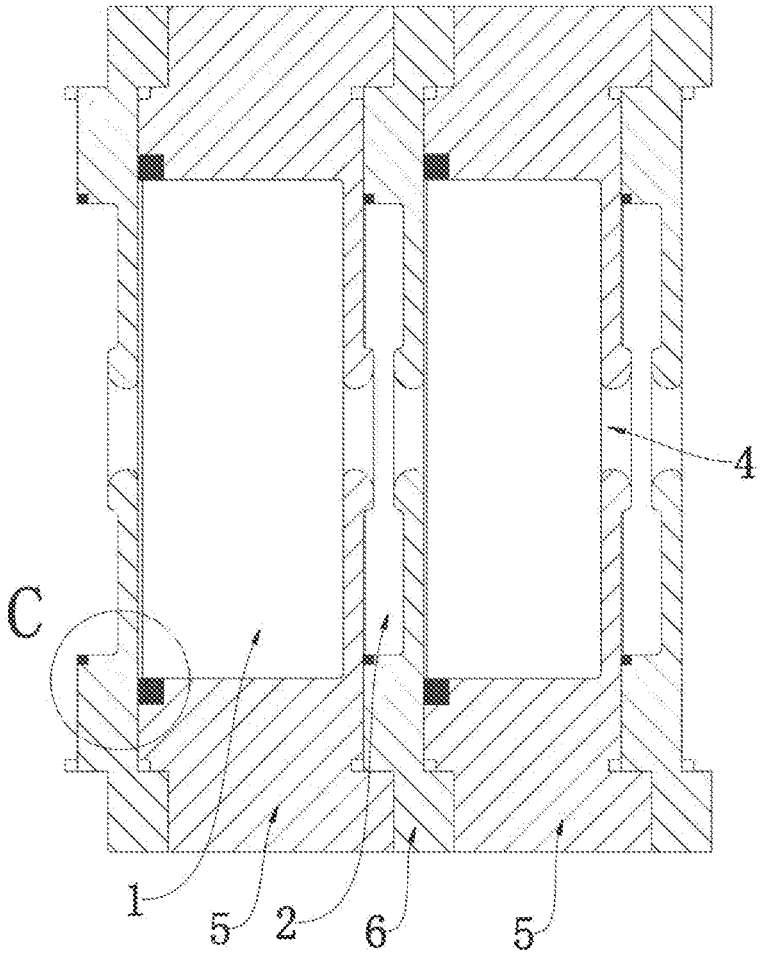
FIG. 3 is a schematic diagram of the radio frequency electron accelerator structure B for local frequency modulation of the present invention.
Figure 4:
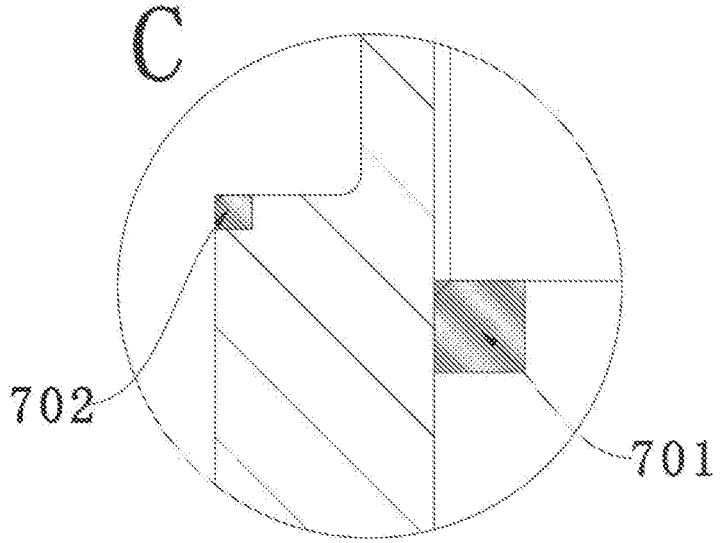
FIG. 4 is an enlarged view of portion C circled in FIG. 3.

Accelerator structure B: as shown in FIG. 3 and FIG. 4, the final structure of the accelerator after local cutting is to form a circular groove on the edge of the accelerating cavity and the edge of the coupling cavity of the accelerator, respectively. The accelerating cavity and the coupling cavity are formed by the interval superimposition of the accelerating cavity component and the coupling cavity component. The accelerating cavity component is provided with a complete accelerating cavity, and the coupling cavity component is provided with a complete coupling cavity.

The accelerating cavity local cutting area 701 is limited to an area shaped as a ring configured to have a cross section of a 1×1 mm square, the ring extends from the joint plane of the accelerating cavity component and the coupling cavity component to the accelerating cavity, and the inner diameter of the ring is equal to the inner diameter of the cavity body of the accelerating cavity.

The coupling cavity local cutting area 702 is limited to an area shaped as a ring configured to have a cross section of a 0.5×0.5 mm square, and the ring extends from the joint plane of the accelerating cavity component and the coupling cavity component to the coupling cavity. In other words, the ring is located on the coupling cavity component, and a starting plane is a plane where the coupling cavity component and the accelerating cavity component joint together to form the coupling cavity. The inner diameter of the ring is equal to the inner diameter of the cavity body of the coupling cavity.

Figure 5:
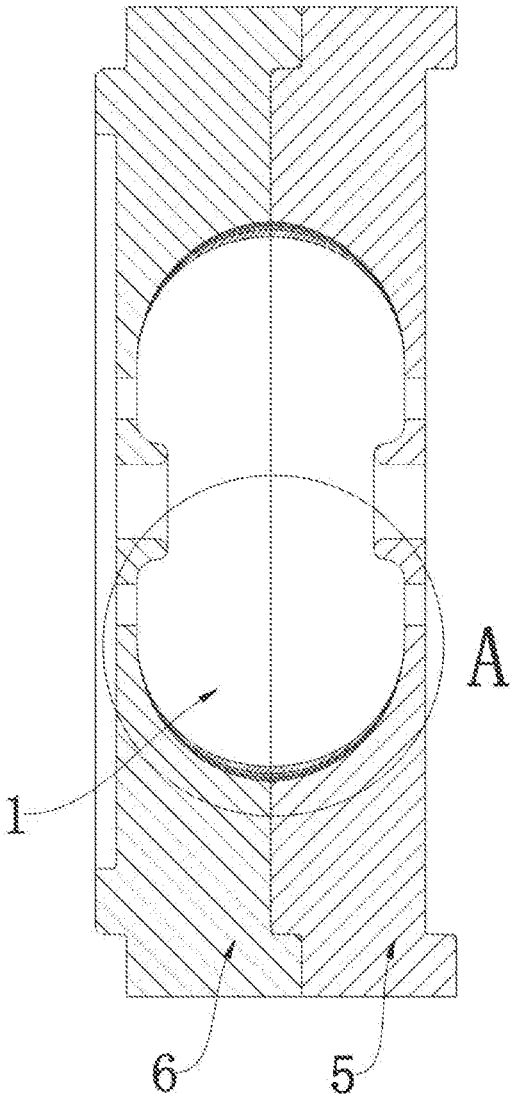
FIG. 5 is a schematic diagram of the overall cutting of the frequency modulation stage according to the prior art.
Figure 6:
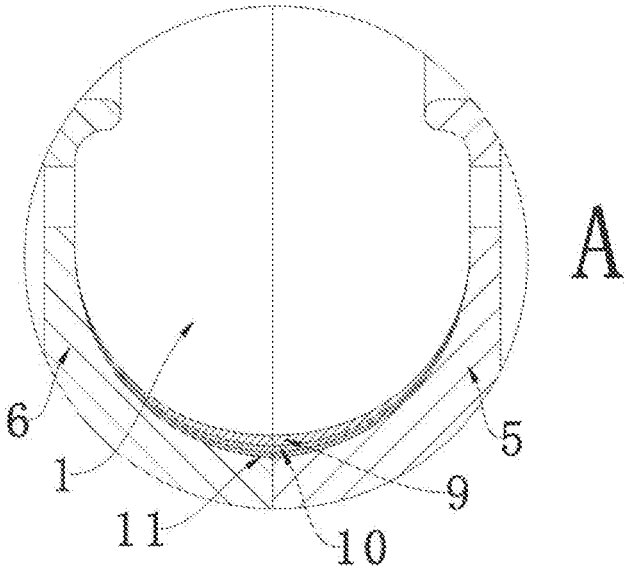
FIG. 6 is an enlarged view of portion A circled in FIG. 5.

As shown in FIG. 5 and FIG. 6, the traditional method of adjusting the intrinsic frequency of the cavity body of the accelerating cavity of the electron accelerator to be greater than the target value is to increase the inner diameter R, i.e., the inner diameter R of the cavity body, by cutting the inner wall of the cavity body of the accelerating cavity. Because the area of the wall surface of the cavity body of the accelerating cavity involved in the cutting portion is relatively large, even a small amount of cutting will cause the volume of the cavity body of the accelerating cavity to change greatly. Thus, it is easy to cause the intrinsic frequency of the cavity body of the accelerating cavity to decrease during the adjusting process, and it is difficult to control the data, and the required machining accuracy is also very high. The operation is to successively cut the first overall cutting area 9, the second overall cutting area 10, and the third overall cutting area 11. This cutting process includes the rough turning stage and the frequency modulation stage of the accelerator in the prior art.

Figure 7:
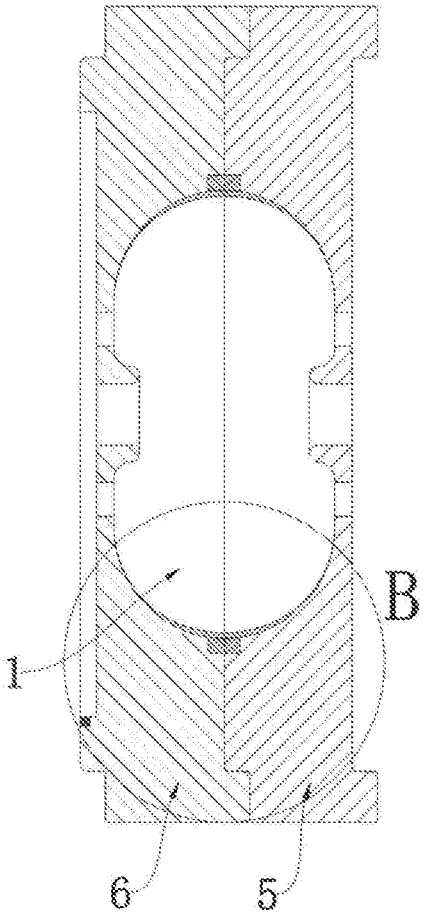
FIG. 7 is a schematic diagram showing the structure of the local cutting in the frequency modulation stage according to the present invention.
Figure 8:
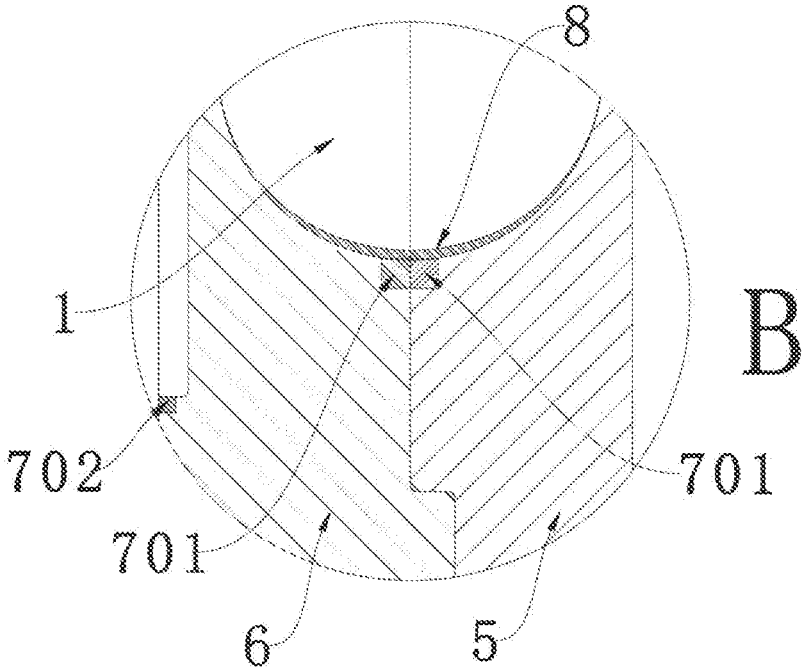
FIG. 8 is an enlarged view of portion B circled in FIG. 7.

As shown in FIG. 7 and FIG. 8, the local frequency modulation method for the accelerator in the present invention is designed based on the radio frequency electron accelerator structure for local frequency modulation. Of course, the above-mentioned two accelerator structures are only two arrangement manners of the local cutting position designed according to the configuration of the accelerator. The general idea is to arrange the local cutting area on the edge of the part to facilitate processing, which is designed according to practical needs. Theoretically, the local cutting area can be arranged inside each cavity body. Since the cavity body of the accelerating cavity is formed by the cooperation of the accelerating cavity component 55 and the coupling cavity component 66, it is very convenient to perform cutting, polishing, and other operations on the wall surfaces of the upper and lower ends of the cavity body of the accelerating cavity component 55 and the coupling cavity component 66, and only a small area need to be cut. When the feed amount is large, the change in the volume of the cavity body of the accelerating cavity is small, so that the change in the intrinsic frequency of the cavity change is small. Therefore, it is easy to control the data, and the required machining accuracy are also reduced.

The present invention provides a local frequency modulation method for a radio frequency electron accelerator. The accelerating cavity component 5 and the coupling cavity component 6 joint together to form the accelerator. In the machining process, the accelerating cavity component 5 and the coupling cavity component 6 are first separated, and then a cutting is performed on a wall surface of a cavity body that is formed by the accelerating cavity component 5 and the coupling cavity component 6, and finally the accelerating cavity component 5 and the coupling cavity component 6 are assembled into a complete accelerating tube. The cutting is divided into a rough turning stage and a frequency modulation stage, and the cutting is performed as follows.

(1) Overall cutting: suitable for the rough turning stage. When each wall surface of the accelerator that is formed by the accelerating cavity component 5 and the coupling cavity component 6 is cut into a plurality of components meeting the specifications according to drawings, an inner surface of the cavity body of the accelerator is integrally cut to quickly reduce a difference between a current intrinsic frequency and a target intrinsic frequency of the cavity body of the accelerating cavity and leave the machining allowance for the frequency modulation stage. In FIG. 8, the overall cutting area 8 represents the cutting position at the rough turning stage.

(2) Local cutting: suitable for the frequency modulation stage. The local cutting area of the cavity body of the accelerator that is formed by the accelerating cavity component 5 and the coupling cavity component 6 is only cut to precisely adjust the current intrinsic frequency of the cavity body to reach the target intrinsic frequency or to fall within an allowable error range of the target intrinsic frequency. In FIG. 8, the accelerating cavity local cutting area 701 and the coupling cavity local cutting area 702 represent the cutting positions at the frequency modulation stage.

Figure 9A:
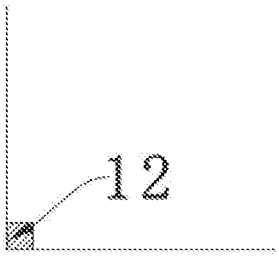
FIGS. 9A-9C are schematic diagrams showing a local frequency modulation method for a radio frequency electron accelerator of the present invention with the vertical square area superimposed cutting according to the present invention.
Figure 9B:
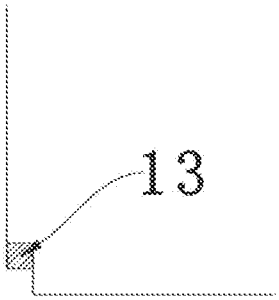
Figure 9C:
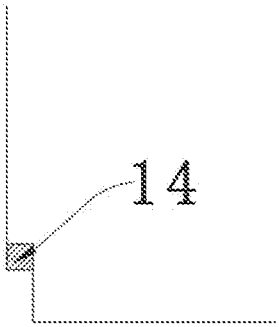
Figure 10A:
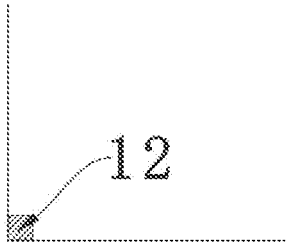
FIGS. 10A-10C are schematic diagrams showing a local frequency modulation method for a radio frequency electron accelerator with the horizontal square area superimposed cutting according to the present invention.
Figure 10B:
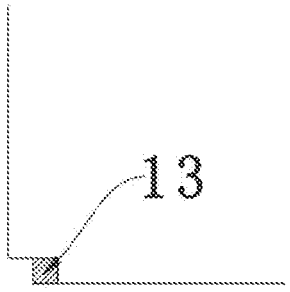
Figure 10C:
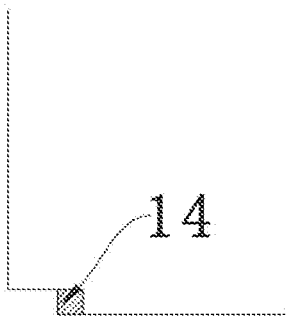
Figure 11A:
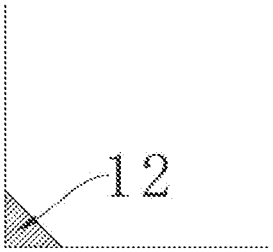
FIGS. 11A-11C are schematic diagrams showing a local frequency modulation method for a radio frequency electron accelerator with the inclined triangular area superimposed cutting according to the present invention.
Figure 11B:
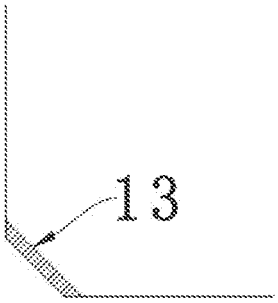
Figure 11C:
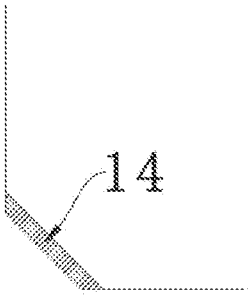

The local cutting adopts a plurality of cutting to ensure the machining accuracy, and the cutting shape is the superimposition of horizontal or vertical square areas, or the superimposition of inclined triangular areas. There is no specific shape for cutting in the local cutting area, as long as the volume of the cavity body can be changed by cutting, but for the convenience of machining and the calculation and control for the volume of the cutting, it is necessary to optimize the current cutting method to develop a more convenient machining method. The machining method adopts the successive superimposition. When machining the local cutting area of the part, the shape of each machining adopts the superimposition of a rectangle, or an inverted triangle to realize the controllable calculation of the volume of the cutting. FIGS. 9A-9C show the superimposition of vertical rectangular cutting. FIGS. 10A-10C show the superimposition of horizontal rectangular cutting. FIGS. 11A-11C shows the superimposition of chamfering operations, namely the superimposition of triangular cutting. The shaded areas indicate the first local cutting area 12, the second local cutting area 13, and the third local cutting area 14 successively.

In the description of the present invention, it should be understood that the terms "center", "longitudinal", "transverse", "length", "width", "thickness", "upper", "lower", "front", "back", "left", "right", "vertical", "horizontal", "top", "bottom", "inner/inside", "outer/outside", "clockwise", "counterclockwise", and other orientations or positional relationships are based on the orientations or positional relationships shown in the figures, which is only for the convenience of describing the present invention and simplifying the description, and does not indicate or imply that the pointed device or element must have a specific orientation, or must be constructed and operated in a specific orientation. Therefore, they cannot be understood as a limitation to the present invention.

In the description of the present invention, unless otherwise clearly specified and defined, "mount", "connect to each other", "connect", "fix", and other terms should be understood broadly. For example, the term "connect" can be understood as, fixed connection, detachable connection, integral connection, mechanical connection, electrical connection, direct connection, indirect connection through an intermediate media, internal communication of the two elements, or interaction between the two elements. For those having ordinarily skill in the art, the specific meanings of the above terms in the present invention can be understood according to the specific situations.

In the present invention, unless otherwise clearly specified and defined, the first feature "on" or "under" the second feature can include direct contact of the first and second features, and can also include contact of the first and second through another feature therebetween instead of the direct contact. Moreover, the first feature "above" and "on" the second feature includes the first feature directly above and diagonally above the second feature, or simply means that the first feature has a higher level than the second feature. The first feature "under" the second feature includes the first feature directly under and diagonally under the second feature, or simply means that the first feature has a lower level than the second feature.

The above is only the preferred embodiments of the present invention. It should be pointed out that the above preferred embodiments shall not be regarded as a limitation on the present invention, and the scope of protection of the present invention shall be subject to the scope defined in the claims. For those skilled in the art, several improvements and refinements can be made without departing from the spirit and scope of the present invention, and such improvements and refinements shall also fall within the protection scope of the present invention.

What is claimed is:

1. A local frequency modulation method for a radio frequency electron accelerator, wherein, an accelerating cavity component and a coupling cavity component joint together to form the radio frequency electron accelerator; in a machining process, first separating the accelerating cavity component and the coupling cavity component, then performing a cutting on a wall surface of a cavity body of the radio frequency electron accelerator, and finally assembling the accelerating cavity component and the coupling cavity component into a complete accelerating tube; the cutting is divided into a rough turning stage and a frequency modulation stage, and the cutting is performed as follows:

(1) overall cutting: wherein the overall cutting is suitable for the rough turning stage; when each wall surface of the radio frequency electron accelerator is cut into a plurality of components meeting specifications according to drawings, integrally cutting an inner surface of the cavity body of the radio frequency electron accelerator to quickly reduce a difference between a current intrinsic frequency and a target intrinsic frequency of the cavity body of the accelerating cavity and leave a machining allowance for the frequency modulation stage; and (2) local cutting: wherein the local cutting is suitable for the frequency modulation stage; only cutting a local cutting area of the cavity body of the radio frequency electron accelerator, to precisely adjust the current intrinsic frequency of the cavity body to reach the target intrinsic frequency or to fall within an allowable error range of the target intrinsic frequency.

2. The local frequency modulation method according to claim 1, wherein, the local cutting adopts a plurality of cutting to ensure a machining accuracy, and a cutting shape is a superimposition of horizontal square areas or vertical square areas, or a superimposition of inclined triangular areas.

* * * * *